United States Patent [19]

Giometti

[11] Patent Number: 4,912,991

[45] Date of Patent: Apr. 3, 1990

[54] THRUST RING FOR A STARTER CLUTCH

[75] Inventor: Paul F. Giometti, Horseheads, N.Y.

[73] Assignee: Facet Enterprises, Inc., Tulsa, Okla.

[21] Appl. No.: 350,711

[22] Filed: May 11, 1989

[51] Int. Cl.[4] ..... F02N 11/00

[52] U.S. Cl. ..... 74/6; 74/7 A; 74/7 C; 192/103 A; 192/114 R

[58] Field of Search ..... 74/6, 7 A, 7 C; 192/103 A, 114 R

[56] References Cited

U.S. PATENT DOCUMENTS

| | | | |
|---|---|---|---|
| 2,368,299 | 1/1945 | Hayter | 192/103 A |
| 3,263,509 | 8/1966 | Digby | 74/6 |
| 3,915,020 | 10/1975 | Johnson | 74/6 |
| 4,114,746 | 9/1978 | Usui et al. | 74/6 X |
| 4,712,435 | 12/1987 | Losey et al. | 74/6 |
| 4,715,239 | 12/1987 | Giometti | 74/6 |

*Primary Examiner*—Leslie A. Braun
*Assistant Examiner*—Janice E. Chartoff
*Attorney, Agent, or Firm*—Remy J. VanOphem

[57] ABSTRACT

An annular thrust ring for use in a mechanism that causes the confronting teeth of two clutch members to automatically separate when the driven clutch member has sufficient speed to overtake the drive clutch member. The annular thrust ring has a V-shaped cross-section formed by progressive dies to facilitate lower production cost.

13 Claims, 1 Drawing Sheet

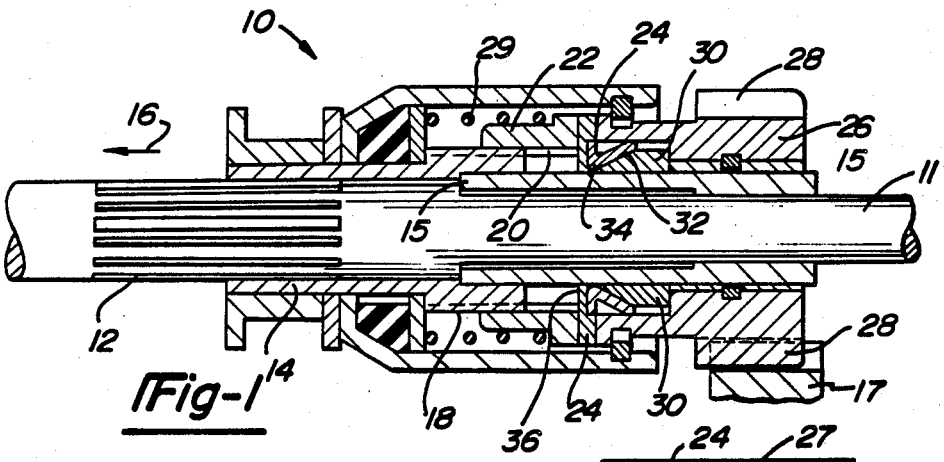
Fig-1
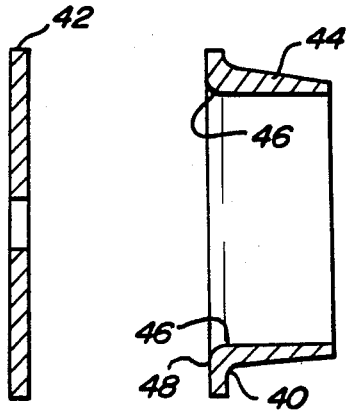
Fig-3
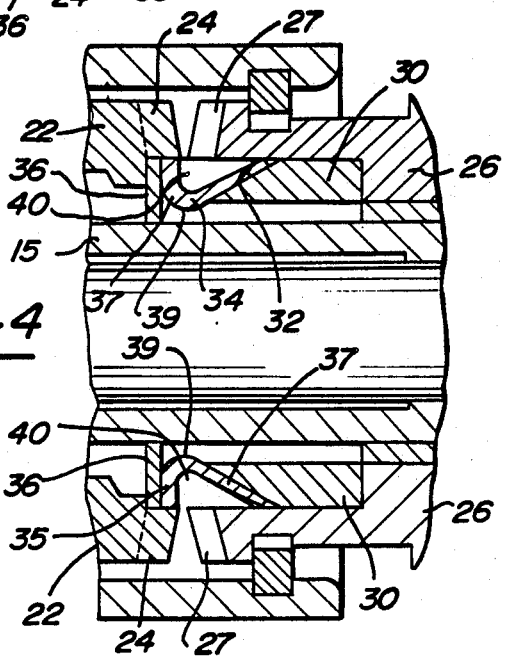
Fig-4
Fig-2

THRUST RING FOR A STARTER CLUTCH

BACKGROUND OF THE INVENTION

1. Field of the Invention

This invention is related to the field of starter clutches for internal combustion engines and in particular to a thrust ring for a starter clutch.

2. Description of the Prior Art

Starter clutches for internal combustion engines of the type taught by Digby in U.S. Pat. Nos. 3,263,509, by Losey in 4,712,435 and by Giometti in 4,715,239 have enjoyed wide acceptance in the automotive industries of the world. These starter clutches employ a plurality of flyweights disposed within a driven member which are radially displaced as a function of the rotational speed of the driven member. The flyweights have included cam surfaces which engage a conical surface of a thrust ring such that the radial displacement of the flyweights produces an axial displacement of the thrust ring. The thrust ring abuts a driving member of the starter clutch which is resiliently biased into engagement with the driven member. When the rotational speed of the driven member exceeds a predetermined speed, the flyweights axially displace the thrust ring which in turn axially displaces the driving member a distance sufficient to disengage the ratchet teeth of the driving member from the ratchet teeth of the driven member.

This flyweight-thrust ring combination is utilized to eliminate severe wear on the ratchet teeth of the clutch when the driven member is rotating faster than the drive member. Additionally, the combination eliminates the noise associated with the chattering of the ratchet teeth that would otherwise accompany overspeeding of the driven member relative to the drive member.

In the clutches disclosed in the above referenced patents, the annular thrust ring is a machined part having a radial face which engages the drive member and an internal conical surface which engages the inclined cam surfaces on the flyweights. The radial and conical surfaces of the thrust ring must be machined to relatively close dimensional tolerances and have a relatively smooth surface finish in order to minimize wear and achieve a satisfactory service life.

SUMMARY OF THE INVENTION

One object of the invention is a thrust ring that is die formed from flat sheet stock at a manufacturing cost substantially less than that of the machined thrust ring presently used. Another object of the invention is to reduce the cost of manufacture of the thrust ring, while achieving at least the same service life as the presently used thrust ring.

Another object of the invention is a thrust ring having an annular flange and a flared cone extending from the internal diameter of the annular flange.

These and other objects of the invention will become more apparent from a reading of a detailed description of the invention with reference to the drawings.

BRIEF DESCRIPTION OF THE DRAWINGS

FIG. 1 is a sectional side view of a starter clutch embodying the present invention;

FIG. 2 is an enlarged fragmentary sectional view showing a portion of the starter clutch with the driving member disengaged from the driven member; and FIGS. 3 and 4 are sectional side views of the thrust ring during fabrication. FIG. 3 shows the blank piece of sheet stock from which the thrust ring is formed, whereas FIG. 4 shows a partially processed thrust ring.

DETAILED DESCRIPTION OF THE PREFERRED EMBODIMENT

FIG. 1 shows a starter clutch for an internal combustion engine that is similar in general arrangement to the clutches shown in U.S. Pat. Nos. 3,263,509, 4,712,435 and 4,715,239 previously mentioned. Structural details not specifically discussed or described herein are similar to corresponding structures shown in those patents.

FIG. 1 shows a starter clutch 10 connected to a power shaft 11 having axial splines 12. The axial splines 12 engage with mating internal splines provided on a sleeve 14. The sleeve 14 can move axially on the power shaft 11 as indicated by arrow 16 to disengage the starter clutch 10 from a gear 17 connected to the drive shaft of an engine (not shown). During each engine start event the power shaft 11 and the sleeve 14 are driven by a starter motor (not shown) to rotate the gear 17 to crank the engine.

Helical splines 18 provided on the sleeve 14 mate with helical splines 20 provided on the inner surface of a drive member 22. The right face of the drive member 22 is machined to form ratchet teeth 24 preferably having a saw tooth profile as shown in the aforementioned U.S. Pat. No. 4,712,435.

A driven member 26 is rotatably supported on a sleeve 15 that is rigidly affixed at one end to the sleeve 14. The left face of the driven member 26 is machined to form ratchet teeth 27 that mesh with the ratchet teeth 24 provided on the drive member 22. A pinion gear 28 adapted to mesh with the gear 17 is provided at one end of the driven member 26.

FIG. 1 shows the components of the starter clutch in an engaged state in which a power-transmission path is established from the power shaft 11 to the gear 17. The power-transmission path incorporates the power shaft 11, the sleeve 14, the drive member 22, the driven member 26, the pinion gear 28 and the gear 17.

As the engine speed increases after it has been started and is operating under its own power, the driven member 26 will be rotated by the engine faster than the drive member 22, such that the ratchet teeth 27 will ratchet forwardly on the ratchet teeth 24, displacing the drive member 22 towards the left as shown in FIG. 1. A spring 29 will produce a force urging the drive member 22 to re-engage the driven member 26. This will cause the ratchet teeth 24 and 27 to be in physical contact with each other producing excessive wear and also a certain amount of noise. To avoid the re-engagement of the drive member's ratchet teeth with the driven member's ratchet teeth, a mechanism is provided to automatically maintain the separation of the ratchet teeth 24 and 27 when the rotational speed of the driven member 26 exceeds a predetermined value. The mechanism includes a plural number of flyweights 30 arranged within a recessed area of the driven member 26. The flyweights respond to rotation of the driven member 26 and produce a centrifugal force urging the flyweights radially outwardly. Theoretically, there can be any number of flyweights, however, three flyweights is a preferred number. Each flyweight can be slidably supported on a radial pin as disclosed in U.S. Pat. No. 3,263,509. Alternately, each flyweight can be slidably guided in a radial pocket or recess as shown in U.S. Pat. Nos. 4,712,435 and 4,715,239.

The left face of each flyweight 30 is acutely angled relative to the axis of rotation of the power shaft 11. Each acutely angled face forms a cam surface 32 that engages a conical surface with an annular thrust ring 34. The construction of the thrust ring 34 is a principal feature of the present invention.

The left face of the thrust ring 34 is an annular flange 35 which engages a thrust washer 36 that circumscribes the sleeve 15 within the space circumscribed by the ratchet teeth 24 on the drive member 22. The thrust washer 36 may be considered as a component part of the drive member 22, although it is free to rotate independently.

As shown in FIG. 2, the outward radial movements of the flyweights 30 cause the thrust ring 34 to be axially displaced to the left so as to assist the axial separation of the ratchet teeth 24 and 27 against the force of the spring 29. Once the ratchet teeth 24 and 27 are separated, the thrust ring 34 will maintain their axial separation, minimizing gear teeth ratchet noise and tooth wear.

As shown in FIGS. 1 and 2, the thrust ring 34 has a V-shaped cross-section. A left leg of the V-shaped cross-section forms the annular flange 35 having a flat surface normal to the power shaft's axis of rotation. This flat surface of the annular flange 35 engages the thrust washer 36. A right leg of the V-shaped cross-section is inclined to the axis of rotation and forms a flared cone 37 having a conical internal surface which is engaged by the cam surfaces 32 of the flyweights 30. The angle of the conical surface of the thrust washer is the complement of the angle of the cam surface 32.

The apex 39 formed by the junction of the flared cone 37 with the annular flange 35 is rounded to have a radius of curvature centered on an imaginary center point 40. This radius of curvature is approximately one half the cross-sectional length of the annular flange 35 between its internal and external diameters. The wall thickness of the annular flange 35 is slightly greater than one half the radius of curvature of the apex 39 measured from the imaginary center point 40.

The thrust ring 34 is formed from flat sheet (plate) metal stock, e.g. steel sheet of a suitable alloy, for being die formed to the desired V-shaped cross-sectional configuration shown in FIG. 2. FIG. 3 shows a piece of flat sheet stock die cut to form a flat one-dimensional annular blank 42. FIG. 4 shows the annular blank 42 after being shaped in a two-piece male-female die. A male die is driven axially through the blank to form a cylindrical portion 44 extending from a radial wall 46 having a rounded annular connector surface.

The structure illustrated in FIG. 4 is placed in another forming die to produce the thrust ring configuration illustrated in FIG. 2. The male portion of the forming die acts as a flaring tool to shape the cylindrical portion 44 into the flared cone 37 having the cross-section shown in FIG. 2. The female portion of the die may be made in two parts which can be separated to permit removal of the formed thrust ring after the final forming operation. During the forming operation the wall thickness of the flared cone 37 becomes tapered from the apex 39 to its outer extremities, as an incidental effect of the flaring process.

The thrust ring 34 can be die formed at relatively low cost without need for machining or other finishing operations. Strength of the thrust ring is enhanced by forming the apex 39 with a rounded surface having a radius of curvature that is relatively large in relation to other dimensions of the thrust ring. The preferred radius of curvature of the apex 39 is at least one half the distance between the internal and external diameters of the annular flange 35. The preferred wall thickness of the sheet metal stock from which the thrust ring is made is slightly more than one half the radius of curvature of the apex 39.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A starter clutch for an internal combustion engine comprising:

a rotary sleeve having external helical splines and an axis of rotation;

an annular drive member circumscribing said rotary sleeve, said drive member having internal helical splines mating with said external helical splines on said rotary sleeve;

an annular driven member rotatably connected to said rotary sleeve concentric with said drive member, each of said drive and driven members having complementary mutually-engageable ratchet teeth for transmitting torque therebetween;

a plurality of centrifugal flyweights arranged within said driven member, said plurality of flyweights being radially displaceable as a function of the rotational speed of said driven member; each said centrifugal flyweight of said plurality of centrifugal flyweights having a cam surface facing said drive member;

a radial thrust washer circumscribing said rotary sleeve within a space circumscribed by said ratchet teeth provided on said drive member; and a thrust ring interposed between said plurality of centrifugal flyweights and said thrust washer, said thrust ring having a V-shaped cross-section having a first leg engaging said radial thrust washer and a second leg engaging said cam surfaces provided on said plurality of centrifugal flyweights.

2. The starter clutch of claim 1 wherein an apex of said V-shaped cross-section formed by said first and second legs has a predetermined radius of curvature.

3. The starter clutch of claim 2 wherein the wall thickness of said first leg of said V-shaped cross-section of said thrust ring is slightly greater than one half of said predetermined radius of curvature of said apex.

4. The starter clutch of claim 3 wherein said predetermined radius of curvature is equal to approximately one half of the length of said first leg.

5. The starter clutch of claim 2 wherein said first leg of said V-shaped cross-section forms an annular flange normal to said axis of rotation and wherein said apex is provided adjacent to the inside diameter of said annular flange.

6. The starter clutch of claim 5 wherein said second leg of said V-shaped cross-section defines a cone having a conical internal surface and wherein said cam surfaces of said plurality of centrifugal flyweights are inclined to mate with said conical internal surface of said cone.

7. The starter clutch of claim 6 wherein said thrust ring is die formed from a sheet metal blank.

8. A starter clutch having a rotary sleeve having an axis of rotation, an annular drive member rotatably connected to said rotary sleeve by helical splines, a driven member rotatably connected to said rotary sleeve, complementary and mutually-engageable ratchet teeth provided in said drive member and said driven member, a plurality of flyweights symmetrically arranged in an annular cavity formed in said driven member, said plurality of flyweights being radially displaceable in response to the rotation of said driven member, each of said flyweights having a cam surface, the improvement comprising:

a thrust ring circumscribing said rotary sleeve between said drive member and said plurality of flyweights, said thrust ring having an annular flange circumscribing said rotary sleeve normal to said axis of rotation, said annular flange being adjacent to said drive member, said thrust ring further having a cone extending from the internal diameter of said annular flange towards said driven member, said cone having an internal conical surface engaged by said cam surfaces of said plurality of flyweights, the radial displacement of said cam surfaces of said plurality of flyweights acting on said conical surface of said cone in response to the rotation of said driven member displacing said thrust ring and said drive member away from said driven member a distance sufficient to disengage said ratchet teeth of said drive member from said ratchet teeth of said driven member.

9. The starter clutch of claim 8 wherein the junction of said cone with said annular flange has a predetermined radius of curvature.

10. The starter clutch of claim 9 wherein said thrust ring has an internal diameter and an external diameter, said predetermined radius of curvature being equal to half the distance between said internal diameter and said external diameter.

11. The starter clutch of claim 9 wherein said cam surface of each flyweight of said plurality of flyweights is an inclined surface disposed at a predetermined angle relative to said axis of rotation, said conical surface is disposed at an angle relative to said axis of rotation which is the complement of said predetermined angle.

12. The starter clutch of claim 9 wherein said thrust ring is die formed from a flat blank of sheet metal.

13. The starter clutch of claim 9 further comprising a thrust washer disposed between said drive member and said thrust ring.

* * * * *